US010464776B2

(12) United States Patent
Ishio et al.

(10) Patent No.: US 10,464,776 B2
(45) Date of Patent: Nov. 5, 2019

(54) METHOD FOR MANUFACTURING COMBINED YARN BUNDLE, AND METHOD FOR MANUFACTURING CARBON FIBER IN WHICH RESULTING COMBINED YARN BUNDLE IS USED (AS AMENDED)

(71) Applicant: TORAY INDUSTRIES, INC., Tokyo (JP)

(72) Inventors: Keiichi Ishio, Iyo-gun (JP); Koichi Aizu, Ehime (JP); Masaki Nakano, Ehime (JP)

(73) Assignee: TORAY INDUSTRIES, INC., Tokyo (JP)

( * ) Notice: Subject to any disclaimer, the term of this patent is extended or adjusted under 35 U.S.C. 154(b) by 114 days.

(21) Appl. No.: 15/567,797

(22) PCT Filed: Apr. 27, 2016

(86) PCT No.: PCT/JP2016/063240
§ 371 (c)(1),
(2) Date: Oct. 19, 2017

(87) PCT Pub. No.: WO2016/181845
PCT Pub. Date: Nov. 17, 2016

(65) Prior Publication Data

US 2018/0134510 A1 May 17, 2018

(30) Foreign Application Priority Data

May 8, 2015 (JP) ..... 2015-095356

(51) Int. Cl.
*D02G 3/24* (2006.01)
*B65H 51/015* (2006.01)
(Continued)

(52) U.S. Cl.
CPC ..... *B65H 51/015* (2013.01); *B65H 51/08* (2013.01); *D01F 9/14* (2013.01); *D01H 13/02* (2013.01);
(Continued)

(58) Field of Classification Search
CPC ..... D02G 3/24; D06C 15/06; D06C 15/02; D06B 23/021; D06B 5/06
See application file for complete search history.

(56) References Cited

U.S. PATENT DOCUMENTS 4,969,322 A * 11/1990 Sasaki ..... D02G 1/0286 28/156
6,625,970 B2 * 9/2003 Schwartz ..... A47C 5/02 57/236
(Continued)

FOREIGN PATENT DOCUMENTS

DE 102015207732 A1 * 11/2016 ..... D06M 10/04
JP S504216 U 1/1975
(Continued)

OTHER PUBLICATIONS

International Search Report and Written Opinion for International Application No. PCT/JP2016/063240, dated Jul. 12, 2016—4 Pages.
(Continued)

*Primary Examiner* — Tajash D Patel
(74) *Attorney, Agent, or Firm* — RatnerPrestia

(57) ABSTRACT

Provided is a method for manufacturing a combined yarn bundle including the steps of bringing the two or more carbon fiber precursor yarns which travel approximately parallel to one another into contact with a first roller at a wrap angle of 20° or more. Then, the two or more carbon fiber precursor yarns are split into two and brought into contact with a pair of second rollers, so that the carbon fiber precursor yarns are rotated approximately 90° between the
(Continued)

first roller and the pair of second rollers. Next, the carbon fiber precursor yarns delivered from one second roller are brought into contact with a third front roller and a third rear roller, and the carbon fiber precursor yarns delivered from the other second roller are brought into contact with the third rear roller without bringing them into contact with the third front roller, so that these carbon fiber precursor yarns are combined on the third rear roller. Thereafter, the carbon fiber precursor yarns delivered from the third rear roller are brought into contact with a fourth roller to obtain a combined yarn bundle. A ratio of a distance L between axes of the first roller and of the pair of second rollers to a yarn width W of the carbon fiber precursor yarn on the first roller, L/W, is 18 or more and a tension of the combined yarn bundle after delivered from the fourth roller is 0.11 cN/dtex or more.

5 Claims, 1 Drawing Sheet

(51) Int. Cl.

| | |
|---|---|
| ***D01F 9/14*** | (2006.01) |
| ***D01H 13/02*** | (2006.01) |
| ***B65H 51/08*** | (2006.01) |
| ***D02G 3/28*** | (2006.01) |
| *D01F 9/32* | (2006.01) |

(52) U.S. Cl.
CPC ..... *D02G 3/24* (2013.01); *D02G 3/28* (2013.01); *B65H 2701/314* (2013.01); *D01F 9/32* (2013.01)

(56) References Cited

U.S. PATENT DOCUMENTS

| | | | | |
|---|---|---|---|---|
| 2004/0221909 | A1* | 11/2004 | Horibe | B65H 51/205 139/11 |
| 2007/0023099 | A1* | 2/2007 | Homma | D06C 15/00 139/426 R |

FOREIGN PATENT DOCUMENTS

| | | | |
|---|---|---|---|
| JP | H01221508 | A | 9/1989 |
| JP | 0226950 | A | 1/1990 |
| JP | 07216680 | A | 8/1995 |
| JP | 09255227 | A | 9/1997 |
| JP | 2012154000 | A | 8/2012 |

OTHER PUBLICATIONS

Extended European Search Report for European Application No. 16792570.0, dated Jun. 5, 2018, 9 pages.

* cited by examiner

METHOD FOR MANUFACTURING COMBINED YARN BUNDLE, AND METHOD FOR MANUFACTURING CARBON FIBER IN WHICH RESULTING COMBINED YARN BUNDLE IS USED (AS AMENDED)

CROSS REFERENCE TO RELATED APPLICATIONS

This is the U.S. National Phase application of PCT/JP2016/063240, filed Apr. 27, 2016, which claims priority to Japanese Patent Application No. 2015-095356, filed May 8, 2015, the disclosures of these applications being incorporated herein by reference in their entireties for all purposes.

TECHNICAL FIELD OF THE INVENTION

The present invention relates to a method for obtaining a combined yarn bundle by combining a plurality of traveling carbon fiber precursor yarns with a group of roller guides, and a method for manufacturing a carbon fiber using the combined yarn bundle.

BACKGROUND OF THE INVENTION

As a precursor for carbon fiber, polyacrylonitrile fiber yarn is widely known. A carbon fiber can be obtained, for example, through an oxidation step in which a polyacrylonitrile fiber yarn as a precursor fiber for carbon fiber is once wound up in a yarn-making step to form a package, the yarn is then unwound from the package, and the precursor yarn is heated and baked in an air atmosphere at a temperature of 200 to 400° C. to be converted into an oxidized fiber yarn; and a carbonization step in which the oxidized fiber yarn is heated at a temperature of 300 to 3000° C. in an inert atmosphere including nitrogen, argon, helium, or the like to be carbonized. Alternatively, the yarn obtained in the yarn-making step is not wound up but is stored in a can or the like, and the stored yarn is then taken out to produce a carbon fiber in the same process as above. The carbon fiber is usually composed of multifilaments constituted of filaments in which the number of monofilaments is 1000 or more.

The application of carbon fibers is being expanded mainly in aerospace applications as a reinforcing fiber for composite materials, and also in sport or general industrial applications. For further expansion of applications, the provision of an inexpensive and high-quality carbon fiber is a critical challenge, and in the step of manufacturing a precursor fiber for carbon fiber, many improvement techniques related to cost reduction due to more effective production have been disclosed. For example, techniques such as thicker yarns to be processed (yarn thickening), narrower yarn width, and smaller interval between yarns (density increase) are effective means for contributing to increase in production amount in limited facilities.

However, in the case where the yarn thickening or the density increase per unit of yarn is easily proceeded, there has been a possibility that especially in a drawing step, a water washing step, a process oil agent application step, or the like, coalescence between monofilaments occurs; fuzz occurs due to the drawing; yarn breakage, insufficient water washing, adhesion irregularity of the oil agent, or the like is caused, so that in the subsequent baking step, fuzz or yarn breakage also occurs to impair processability, and a problem leading to deterioration of physical properties of the resulting carbon fiber may be caused. Therefore, thickened and highly dense yarns are often subjected to convergence improvement treatment between monofilaments such as being intermingled. However, in the case where the yarn is a carbon-fiber-precursor acrylic yarn, intermingling for yarn thickening impairs spreadability of the yarn, so that, for example, when formed into a prepreg sheet, the baked carbon fiber cannot be uniformly formed into the sheet, leading to deterioration in quality.

Therefore, as a method of combining the carbon-fiber-precursor acrylic yarn without impairing the spreadability of the yarn, for example, Patent Document 1 discloses a yarn combining method which includes squeezing a yarn once between two rollers and then twisting the squeezed yarn with a separately provided roller. Further, Patent Document 2 discloses a combining method of a filament bundle, which includes bringing guides into contact with three or more traveling filaments almost in the perpendicular direction in the first stage, doubling the traveling filaments which have passed through the first stage while bringing them into contact with other two parallelly arranged guides in the second stage, and subsequently twisting the doubled filaments at 45° to 90° by using a further provided guide.

PATENT DOCUMENTS

Patent Document 1: Japanese Patent Laid-open Publication No. 2-26950

Patent Document 2: Japanese Patent Laid-open Publication No. 7-216680

SUMMARY OF THE INVENTION

The method of Patent Document 1 is effective in combining yarns made of 2000 or less filaments. However, when yarns made of more than 2000 filaments are combined, the distances from the two yarns to the first roller are different, so that the yarn width in the combined portion becomes unstable, and as a result, the combined yarn tends to be split, disadvantageously failing to obtain a continuously stable combined yarn bundle. The combined yarn bundle that frequently causes splitting significantly impairs operability in the subsequent steps, so that, for example, when formed into a prepreg sheet, the baked carbon fiber cannot be uniformly formed into the sheet, leading to deterioration in quality.

Further, the method of Patent Document 2 is effective in combining yarns made of 2000 or less filaments. However, when three or more yarns made of more than 2000 filaments are combined, a continuously stable combined yarn bundle disadvantageously fails to be obtained in the same manner.

Accordingly, it is an object of the present invention to eliminate such problems of the prior art and particularly to provide a method for obtaining a combined yarn bundle in a continuously stable manner while splitting of the combined yarn bundle is prevented, even in the case of a thick yarn made of more than 1000 filaments.

To achieve the above object, a method for manufacturing a combined yarn bundle according to the present invention has the following constitution. That is, a method for manufacturing a combined yarn bundle by combining two or more carbon fiber precursor yarn using the following rollers (1) to (4), including the steps of bringing the two or more carbon fiber precursor yarns which travel in approximately parallel to one another into contact with a first roller at a wrap angle of 20° or more; then splitting the two or more carbon fiber precursor yarns into two to be brought into contact with a pair of second rollers, so that the carbon fiber precursor yarns are rotated approximately 90° between the first roller and the pair of second rollers; next, sequentially bringing the carbon fiber precursor yarns delivered from one second roller into contact with a third front roller and a third rear roller, and also bringing the carbon fiber precursor yarns delivered from the other second roller into contact with the third rear roller without bringing them into contact with the third front roller, so that these carbon fiber precursor yarns are combined on the third rear roller; and thereafter, bringing the carbon fiber precursor yarns delivered from the third rear roller into contact with a fourth roller at a wrap angle of 5° or more to obtain a combined yarn bundle, so that a ratio of a distance L between axes of the first roller and of the pair of second rollers to a yarn width W of the carbon fiber precursor yarn on the first roller, L/W, is 18 or more and a tension of the combined yarn bundle after delivered from the fourth roller is 0.11 cN/dtex or more. The term "approximately parallel" herein means parallel or that the angle formed between two yarns is 5° or less. The term "approximately 90° " refers to a range of 85 to 95°.

(1) A first roller;

(2) a pair of second rollers having an axis approximately orthogonal to both an axis of the first roller and a traveling direction of the carbon fiber precursor yarns immediately after delivered from the first roller, the axes of which are at approximately equal distances L from the axis of the first roller;

(3) a third front roller and a third rear roller each having an axis parallel to the axes of the pair of second rollers, being arranged in order along a traveling direction of carbon fiber precursor yarns immediately after delivered from the pair of second rollers; and (4) a fourth roller having an axis approximately orthogonal to the third front rollers and the third rear rollers.

The term "approximately orthogonal" herein means that the angle formed between the two axes or between the axis and the yarn is in a range of 85 to 95°.

Further, a method for manufacturing a carbon fiber according to the present invention includes a step of subjecting the combined yarn bundle manufactured by the above-mentioned method for manufacturing the combined yarn bundle to oxidation treatment and carbonization treatment to thereby obtain a carbon fiber.

According to the present invention, even with a thick yarn, a carbon fiber precursor yarn rarely causing splitting and having high quality can be obtained in a continuously stable manner. This leads to little occurrence of fuzz or splitting in a carbon fiber baking step and a high-order processing step.

DETAILED DESCRIPTION OF EMBODIMENTS OF THE INVENTION

Figure 1:
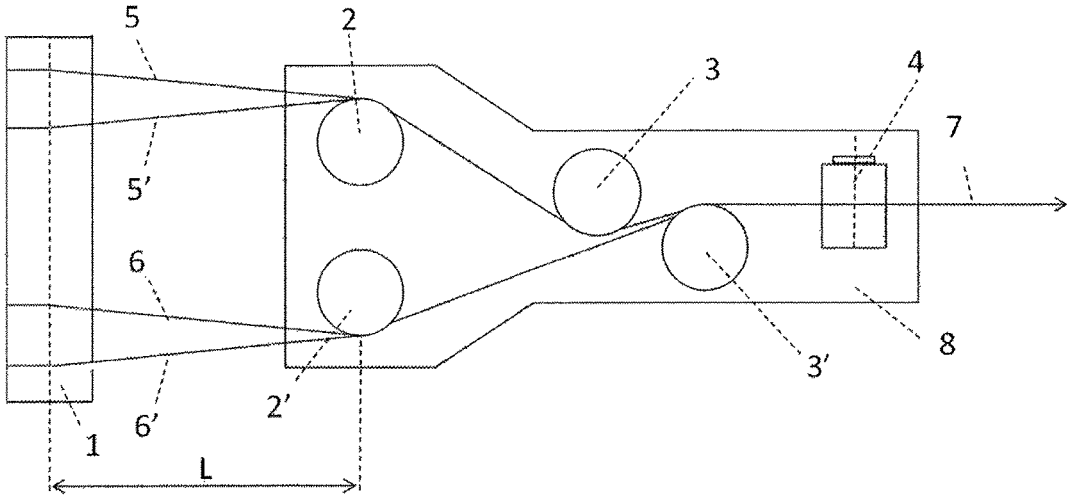
FIG. 1 shows a schematic plan view illustrating an example of a combining apparatus according to the present invention.

An embodiment of the present invention will be described hereinbelow in detail. A material of a carbon fiber precursor yarn is not particularly limited, and mainly an acrylic polymer composed of acrylonitrile, specifically a copolymer composed of 85% by mass or more of acrylonitrile and 15% by mass or less of other comonomer is preferable. Examples of the comonomer include acrylic acid, methacrylic acid, itaconic acid, and alkyl esters thereof such as methyl ester, ethyl ester, propyl ester, and butyl ester; alkali metal salt, ammonium salt, or allyl sulfone salt, methallyl sulfone salt, styrene sulfone salt, and alkali metal salts thereof, without being limited thereto. When the ratio of the comonomer in the copolymer exceeds 15% by mass, the physical properties of the carbon fiber finally obtained may be deteriorated. The acrylic polymer can be polymerized using a general polymerization method such as emulsion polymerization, bulk polymerization, solution polymerization, or the like. A particularly preferred ratio of the acrylonitrile in the copolymer is 95% by mass or more.

A polymer solution composed of the acrylic polymer; an organic solvent such as dimethyl acetamide, dimethyl sulfoxide, and dimethylformamide; and an aqueous solution of an inorganic matter such as nitric acid, zinc chloride, and sodium rhodanide is used as a spinning dope, spinning is performed by a general wet spinning method or a dry-jet wet spinning method to obtain a coagulated yarn. The resulting coagulated yarn is subjected to in-bath drawing preferably in a bath of 50 to 98° C. at a draw ratio of about 2 to 6. The yarn obtained by spinning is preferably washed after in-bath drawing or subjected to in-bath drawing after washing to thereby remove the remaining solvent. After the in-bath drawing, an oil agent is preferably applied to the yarn, and the yarn is densely dried with a hot roller, to thereby obtain a carbon fiber precursor yarn. Further, if necessary, secondary drawing such as steam extension is subsequently performed. The plurality of carbon fiber precursor yarns thus obtained are combined by a group of free roller guides for yarn convergence, and thereafter the yarns are wound up with a winding machine or stored in a can. As another embodiment, a plurality of the wound yarns are unwound or taken out from the can, and may also be combined by the group of free roller guides for convergence.

The carbon fiber precursor yarn to be supplied for combining preferably has a degree of intermingle of 20 or less. When the degree of intermingle exceeds 20, splitting of the combined yarn bundle tends to occur. Some of the carbon fiber precursor yarns to be supplied for combining are preferably converged, and preferably have a degree of intermingle of 1.5 or more. The degree of intermingle used herein is determined by a hook drop method, that is, by a distance through which a hook falls in accordance with JIS L1013 (2010).

The roundness of the monofilament in the carbon fiber precursor yarn is preferably 0.9 or more. The term "roundness of the monofilament" herein refers to roundness of the monofilament in the carbon fiber precursor yarn before contact with a first roller. When the roundness is less than 0.9, the converging property of the yarn may deteriorate. As a result, the yarns are not uniformly entangled with each other, pre-combination from a pair of second rollers to a pair of third front rollers and third rear rollers does not exhibit any effect, which may cause variation in the combined yarn state. To achieve a yarn made of monofilaments having a desired roundness, coagulation and take-up conditions in a spinning step, in particular, concentration and temperature of a solvent in a coagulated bath, are preferably adjusted.

When the number of monofilaments (filaments) that constitute the carbon fiber precursor yarn exceeds 1000, more preferably 2000, the effect of the method for manufacturing the combined yarn bundle of the present invention can be suitably obtained. The number of filaments is not particularly limited, and is usually 70000 or less.

Figure 2:
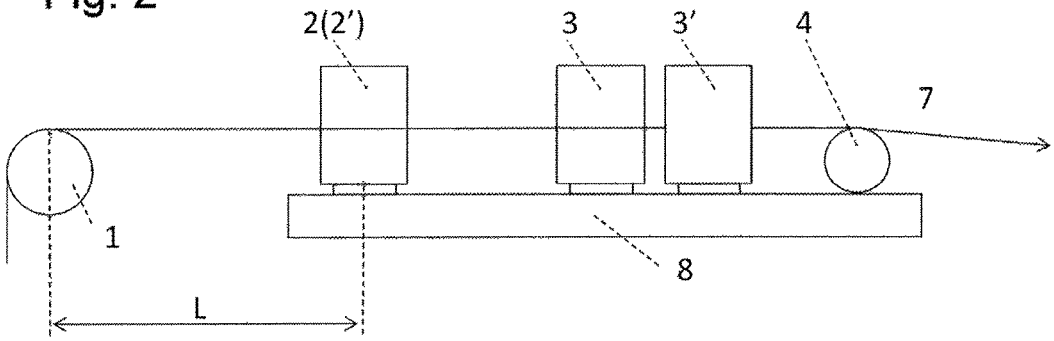
FIG. 2 shows a schematic side view illustrating an example of a combining apparatus according to the present invention.

The construction of a combining apparatus with a group of free roller guides, which is used in the method for manufacturing the combined yarn bundle of the present invention, will be specifically described with reference to the drawings hereinbelow. FIG. 1 shows a schematic plan view illustrating an example of an apparatus used in combining means according to the present invention, and FIG. 2 shows a schematic side view of the apparatus in FIG. 1, each illustrating an example of combining four yarns. The present invention is not limited to the embodiments shown in FIGS. 1 and 2.

A first roller 1 and a pair of second rollers 2 and 2' are placed so that a distance between the axes of the rollers is L and so that the yarns delivered from first roller 1 are introduced into a approximately center position in the widthwise direction of each of second rollers 2 and 2'. The pair of second rollers 2 and 2' and a pair of third rollers 3 and 3' are placed at approximately the same height, and the yarns delivered from the pair of third rollers 3 and 3' are placed at a position in contact with the surface of a fourth roller 4.

Here, the first roller may be either a free rotating roller or a drive roller, and is preferably a drive roller. The second to fourth rollers may also be either free rotating rollers or drive rollers, and are preferably free rotating rollers.

Figure 3:
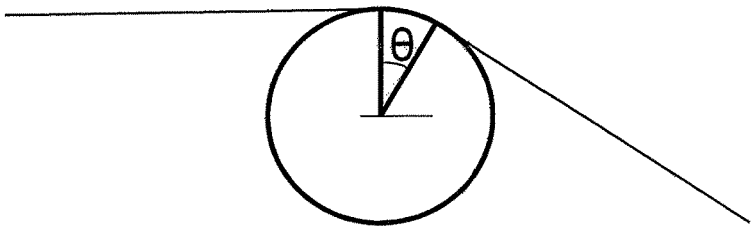
FIG. 3 shows schematic view for explaining a wrap angle.

In a method for manufacturing the combined yarn bundle of the present invention, at a first stage, yarns 5, 5', 6, and 6' which travel in approximately parallel to one another are brought into contact with first roller 1 at a wrap angle of 20° or more to thereby stabilize a yarn path, and the yarns are thereafter introduced onto the pair of second rollers. The term "approximately parallel" herein means parallel or that the angle formed between two yarns is 5° or less. The term "wrap angle" means an angle at a portion where the roller and the yarn are in contact with each other as shown in FIG. 3. The wrap angle is represented as θ in FIG. 3. FIG. 2 shows an example in which the wrap angle on the first roller is 90°. The wrap angle of the yarn on the first roller is 20° or more, and preferably from 30 to 120°. When the wrap angle is less than 20°, the yarn path is not stable and the convergence state of the combined yarn bundle may become unstable. When the wrap angle exceeds 120°, the convergence state of the yarn bundle is not particularly affected, but the yarn path becomes complicated.

In an embodiment of the present invention, a ratio of a distance L between the first roller and the pair of second rollers to a yarn width W of the carbon fiber precursor yarn, L/W, is 18 or more. W is an average of the widths of the carbon fiber precursor yarns before combining on the first roller. The average of the yarn width used herein is obtained by visually measuring three times the yarn widths of a plurality of carbon fiber precursor yarns in millimeters on the first roller at an interval of 20 seconds using a ruler and then averaging all the measured yarn widths. L means a distance between the axis of the first roller and the axis of each of the pair of second rollers. The axes of the pair of second rollers are at approximately equal distances from the axis of the first roller. The term "approximately equal" used herein means that the distance between the axis of first roller 1 and that of second roller 2 and the distance between the axis of first roller 1 and that of second roller 2' are equal or even if different, the difference therebetween is 5% or less. The distances between those axes are preferably equal. When the pair of second rollers do not have the same distance from the axis of the first roller, a smaller distance between the axes of the first and the second rollers is determined as L. The ratio of L/W is preferably 50 or more. From the viewpoint of stability of or space for the yarn path, the ratio of L/W is preferably 100 or less. When the ratio of L/W is less than 18, the yarns that come in contact perpendicularly from the first roller to the axis directions of the pair of second rollers are converged on the pair of second rollers to be formed into a rope, so that the splitting ratio of the resulting combined yarn bundle tends to be larger than 10%. The splitting ratio is preferably 10% or less. When the splitting ratio of the combined yarn bundle of the carbon fiber precursor yarns exceeds 10%, fuzz or yarn breakage occurs in the baking step to impair stable production and also the physical properties of the resulting carbon fiber may deteriorate. The method of determining the splitting ratio will be described later.

The carbon fiber precursor yarn delivered from the first roller is split into two and the split two yarns are brought into contact with the pair of second rollers, respectively. The "split into two" means that in the embodiment shown in FIG. 1, four yarns are split into two groups of yarns including two in each group.

The second roller has an axis approximately orthogonal to both the axis of the first roller and the traveling direction of the carbon fiber precursor yarn immediately after delivered from the first roller, so that the carbon fiber precursor yarns rotate approximately 90° relative to the fiber length direction between the first roller and the pair of second rollers. This makes the yarn path stable, so that the combined yarn state is readily stabilized, and without significantly changing the yarn width W on the first roller, two yarns are introduced onto the second rollers, which is preferable. The wrap angles of both the two yarns on the second rollers are preferably 10° or more, and more preferably from 20° to 90°. In this case, of the wrap angles of the two yarns, a wrap angle of the inner side yarn is, of course, larger, and such larger wrap angle is preferably 90° or less, and the smaller wrap angle is preferably 10° or more.

Of the yarn bundles obtained by overlapping two yarns on the second roller and then combining them, one yarn bundle delivered from second roller 2 comes in contact with third front roller 3, and subsequently with third rear roller 3'. The other yarn bundle delivered from second roller 2' directly comes in contact with the third rear roller 3' without coming in contact with third front roller 3. All these yarns are combined into one on third rear roller 3'.

Third front roller 3 and third rear roller 3' each have an axis parallel to the axes of the pair of second rollers, and are arranged in order along the traveling direction of the carbon fiber precursor yarns immediately after delivered from the pair of second rollers.

For the same reason as the second rollers, the wrap angles of the yarns on the third rollers, that is, both the third front rollers and the third rear rollers, are preferably 10° or more, and more preferably from 20° to 90°.

The yarn bundle delivered from third rear roller 3' comes in contact with fourth roller 4 and then introduced onto the subsequent roller (not shown).

The fourth roller has an axis approximately orthogonal to the third front rollers and the third rear rollers.

The wrap angle of the yarn on the fourth roller is 5° or more and preferably from 10° to 90°. Setting the wrap angle to 5° or more produces a twist in the yarn at 5° or more by the fourth roller, to thereby generate entanglement between monofilaments in the combined yarns, so that the effect of combining yarns can be exhibited. Further, setting the wrap angle to 90° or less can impart converging property to the yarns without splitting the combined yarn bundle due to yarn twisting.

When the yarn is introduced onto fourth roller 4, the yarn path is adjusted so that the upper end of the yarn from third rear roller 3' is present above the upper end portion of fourth roller 4 and that the lower end of the yarn is present below the upper end portion of fourth roller 4, to thereby impart a twist to the yarn, which is preferred to give converging property to the yarn.

FIGS. 1 and 2 show drawings in which yarns to be combined for the purpose of illustration are arranged so that a first pair of yarns are on the upper side and a second pair of yarns are on the lower side in FIG. 1, the first pair of yarns being in contact with the third front roller. The positioning of these yarns can vary within a range in which the above yarn path can be formed.

The distance between the axes of the third rear roller and of the fourth roller is preferably 100 mm or less. The distance is more preferably 50 mm or less. When the distance exceeds 100 mm, the entanglement between monofilaments due to the twist is not effective, which may tend to cause splitting.

By setting the tension of the combined yarn bundle which has come in contact with the fourth roller to 0.11 cN/dtex or more, the position of the yarn becomes stable, and the monofilaments are uniformly incorporated upon combination between yarns, thereby to prevent splitting from readily occurring. When the tension is less than 0.11 cN/dtex, the position of the yarn bundle tends to become unstable and the pressing force between the yarn bundles tends to become insufficient, so that splitting readily occurs. Further, when the tension is excessively high, the monofilaments are not incorporated into the monofilaments upon combination between the yarns, and splitting of the combined yarn bundle tends to occur, so that the tension is preferably 0.80 cN/dtex or less. Therefore, it is preferable that the tension is within a range of 0.11 to 0.80 cN/dtex from the viewpoint of reducing splitting to obtain a carbon fiber precursor yarn bundle having good yarn quality. For the measurement of the tension, for example, a tension meter HS-3000 (manufactured by Eiko Sokki Inc.) and a tension pickup BTB-I (manufactured by Eiko Sokki Inc.) at rates of 5 kgf and 10 kgf can be used.

In the case of two yarns to be combined, first, one of the yarns comes in contact with second roller 2 and the other yarn, with second roller 2', so that the yarn path is stabilized. The yarns introduced onto the second rollers are then introduced onto the pair of third rollers placed in parallel to the second rollers, and the yarns thus introduced are overlapped in agreement with their orientation. The resulting yarn bundle is then introduced onto the fourth roller approximately orthogonal to the axis of the third roller and combined.

In the case of three yarns to be combined, of the three yarns, one or two yarn(s) is/are introduced onto second roller 2 and the remaining one or two yarn(s) is/are brought into contact with the other second roller 2' to thereby stabilize yarn paths for the respective yarns. The yarns introduced onto the second rollers are then introduced onto the pair of third rollers placed in parallel to the second rollers, and the yarns thus introduced are overlapped in agreement with their orientation. The resulting yarn bundle is then introduced onto the fourth roller approximately orthogonal to the axis of the third roller and combined.

Similarly, in the case of four yarns to be combined, the yarns are divided into three yarns and one yarn; in the case of five yarns to be combined, the yarns are divided into four yarns and one yarn, and the same steps may be performed with these yarns. Preferably, the four yarns are divided into two yarns each, the five yarns are divided into three and two yarns (so that the number of yarns is approximately equal), and the same steps are preferably performed with these yarns. Here, when the number thereof is approximately equal, it means that the number of divided yarns is equal or different by one only. The same applies to the more number of yarns.

As an example of the roller to be used in the above-mentioned apparatus, a known guide or guide roller may be used, and in particular, a fixed cylindrical guide, a shell rotation type guide roller including a bearing, or the like is preferably used. The roller preferably has a matted surface. The diameter of the roller is preferably in the range of 10 to 30 mm. A guide for stabilizing the yarn path may also be used, other than the pair of second rollers and the pair of third rollers as described above.

Next, a method for manufacturing a carbon fiber of the present invention will be described.

The combined yarn bundle made of carbon fiber precursor yarns manufactured by the method for manufacturing the combined yarn bundle described above is subjected to oxidation treatment in an air at 200 to 300° C. The oxidized yarn obtained by the oxidation is subjected to pre-carbonization treatment in an inert atmosphere at 300 to 900° C., and then subjected to carbonization treatment in an inert atmosphere at 1000 to 3000° C., to manufacture a carbon fiber. As a gas used in the inert atmosphere, nitrogen, argon, and xenon can be exemplified. From the economical viewpoint, nitrogen is preferably used.

In the present invention, roundness, degree of intermingle, and splitting ratio are determined by the following methods.

<Roundness>

Carbon fiber precursor yarns before combining are sampled, the sampled yarn is cut perpendicular to the fiber axis with a razor, and the cross-sectional shape of a single fiber is observed with an optical microscope. The measuring magnification is set to 200 to 400 times so that the narrowest single fiber is observed to be about 1 mm. The number of pixels in the device to be used is 2 million pixels. The cross-sectional area and perimeter of the monofilament that constitutes the carbon fiber precursor yarn are determined by analyzing the resulting image, and the diameter (fiber diameter) of the cross section of the monofilament when assumed to be round from the cross-sectional area is calculated by the unit of 0.1 μm, to determine the roundness of the monofilament that constitutes the carbon fiber precursor yarn using the following formula. As the roundness, the average of randomly selected 10 monofilaments is used.

$$\text{Roundness}=4\pi S/L^2$$

wherein S represents a cross-sectional area of the monofilament that constitutes a carbon fiber precursor yarn, and L represents a perimeter of the monofilament.

<Degree of Intermingle by Hook Drop Method>

The degree of intermingle is determined in accordance with the degree of intermingle measurement method under JIS L1013 (2010) "Chemical Fiber to Filament Yarn Testing Methods". A load of 100 g is attached to a specimen of the carbon fiber precursor yarn before combining at a lower position to let the specimen hang vertically. A hook of a load (10 g) is inserted into the upper portion of the specimen, and a drop distance (mm) that the hook has traveled until it is stopped by an entanglement of yarns is then measured, and the degree of intermingle is calculated from the drop distance using the following formula. The number of measurements is designated as n=50, and the average of the measured values is determined as the degree of intermingle.

Degree of intermingle=1000/drop distance of hook

<Splitting Ratio>

When the combined yarn bundle of the precursor fiber for carbon fiber is unwound 1000 m under conditions of a tension of 0.04 cN/dtex at 5 m/min, the occurrence of 3 m or more splitting is examined. The measurement is performed 100 times and a ratio (%) of the number of occurrence of 3 m or more splitting to a total number of measurements is determined as a splitting ratio.

EXAMPLES

Example 1

In the apparatus of FIG. 1, a distance L between the axes of the pair of second rollers 2 and 2' and the axis of first roller 1 was set to 200 mm, and the pair of third rollers 3 and 3' were arranged in a position where the yarn path was overlapped with the widthwise center of a fourth roller. The interval between the fourth roller and third rear roller 3' was 40 mm. Using the above-mentioned combining apparatus, when four multifilament yarns each having a total fineness of 3300 dtex (monofilament fineness: 1.1 dtex, number of monofilaments: 3000) were combined under the conditions listed in Table 1, and splitting was then examined, the splitting ratio was 3%.

The rollers were arranged so that first roller 1 had a wrap angle of 60°; second rollers 2 and 2', 45°; third front roller, 50°; third rear roller, 45°; and the fourth roller, 60°.

Example 2

When a yarn before combining having a degree of intermingle of 21.2 was used in Example 1, the splitting ratio was 9%.

Example 3

When two multifilament yarns (monofilament fineness: 0.11 tex) having a total fineness of 13200 dtex were combined in Example 1 and splitting was then similarly examined, the splitting ratio was 4%.

Example 4

When two multifilament yarns (monofilament fineness: 1.1 dtex, number of monofilament: 3000) having a roundness of 0.78 were combined and splitting was then examined, the splitting ratio was 8%.

Comparative Example 1

When the distance between the pair of second rollers 2 and 2' and the first roller 1 was set to 30 mm in Example 1, the splitting ratio was 23%.

Comparative Example 2

When the distance between the pair of second rollers 2 and 2' and the first roller 1 was set to 50 mm in Example 1, the splitting ratio was 21%.

Comparative Example 3

When the distance between the pair of second rollers 2 and 2' and the first roller 1 was set to 30 mm in Example 2, the splitting ratio was 25%.

Comparative Example 4

When the distance between the pair of second rollers 2 and 2' and the first roller 1 was set to 150 mm in Example 2, the splitting ratio was 14%.

Comparative Example 5

When the tension of the yarn bundle after combining was adjusted to 0.08 cN/dtex in Example 2, the splitting ratio was 49%.

Comparative Example 6

When the tension of the yarn bundle after combining was adjusted to 0.10 cN/dtex in Example 3, the splitting ratio was 36%.

TABLE 1

| | Distance L between first roller and second roller [mm] | Total fineness dtex | No. of monofilaments — | No. of combined yarns — | Yarn width W on first roller [mm] | L/W — | Roundness — | Degree of intermingle before combining — | Tension after combining cN/dtex | Splitting ratio [%] |
|---|---|---|---|---|---|---|---|---|---|---|
| Example 1 | 200 | 3300 | 3000 | 4 | 4.3 | 46 | 0.92 | 6.2 | 0.19 | 3 |
| Example 2 | 200 | 3300 | 3000 | 4 | 4.0 | 50 | 0.92 | 21.2 | 0.17 | 9 |
| Example 3 | 200 | 13200 | 12000 | 2 | 11.3 | 18 | 0.92 | 9.6 | 0.16 | 4 |
| Example 4 | 200 | 13200 | 12000 | 2 | 10.7 | 19 | 0.78 | 9.8 | 0.16 | 8 |
| Comparative Example 1 | 30 | 3300 | 3000 | 4 | 4.0 | 8 | 0.92 | 7.1 | 0.19 | 23 |
| Comparative Example 2 | 50 | 3300 | 3000 | 4 | 4.3 | 12 | 0.92 | 6.0 | 0.17 | 21 |
| Comparative Example 3 | 30 | 13200 | 12000 | 2 | 11.3 | 3 | 0.92 | 9.5 | 0.15 | 25 |
| Comparative Example 4 | 150 | 13200 | 12000 | 2 | 11.3 | 13 | 0.92 | 10.2 | 0.14 | 14 |
| Comparative Example 5 | 200 | 13200 | 12000 | 2 | 11.0 | 18 | 0.92 | 10.0 | 0.08 | 49 |
| Comparative Example 6 | 200 | 13200 | 12000 | 2 | 10.7 | 19 | 0.92 | 9.6 | 0.10 | 36 |

DESCRIPTION OF REFERENCE SIGNS

1: First roller
2, 2': Second rollers
3: Third front roller
3': Third rear roller
4: Fourth roller
5, 5', 6, 6': Carbon fiber precursor yarns before combining
7: Carbon fiber precursor yarns after combining
8: Common base for fixing second rollers A, B, third front roller, third rear roller, and fourth roller
L: Distance between first roller and second rollers A and B
θ: Wrap angle

The invention claimed is:

1. A method for manufacturing a combined yarn bundle by combining two or more carbon fiber precursor yarns using the following rollers (1) to (4), comprising the steps of:

bringing the two or more carbon fiber precursor yarns which travel in approximately parallel to one another into contact with a first roller at a wrap angle of 20° or more; then splitting the two or more carbon fiber precursor yarns into two to be brought into contact with a pair of second rollers, so that the carbon fiber precursor yarns are rotated approximately 90° between the first roller and the pair of second rollers; next, sequentially bringing the carbon fiber precursor yarns delivered from one second roller into contact with a third front roller and a third rear roller being substantially offset from one another, and also bringing the carbon fiber precursor yarns delivered from the other second roller into contact with the third rear roller without bringing them into contact with the third front roller, so that these carbon fiber precursor yarns are combined on the third rear roller; and thereafter, bringing the carbon fiber precursor yarns delivered from the third rear roller into contact with a fourth roller at a wrap angle of 5° or more to obtain a combined yarn bundle, so that a ratio of a distance L between axes of the first roller and of the pair of second rollers to a yarn width W of the carbon fiber precursor yarn on the first roller, L/W, is 18 or more and a tension of the combined yarn bundle after delivered from the fourth roller is 0.11 cN/dtex or more;

(1) a first roller;

(2) a pair of second rollers having an axis approximately orthogonal to both an axis of the first roller and a traveling direction of the carbon fiber precursor yarns immediately after delivered from the first roller, the axes of which are at approximately equal distances L from the axis of the first roller;

(3) a third front roller and a third rear roller each having an axis parallel to the axes of the pair of second rollers, being arranged in order along a traveling direction of carbon fiber precursor yarns immediately after delivered from the pair of second rollers; and (4) a fourth roller having an axis approximately orthogonal to the third front rollers and the third rear rollers.

2. The method for manufacturing a combined yarn bundle according to claim 1, wherein a splitting ratio of the obtained combined yarn bundle is 10% or less.

3. The method for manufacturing a combined yarn bundle according to claim 1, wherein the carbon fiber precursor yarn before contact with the first roller has a degree of intermingle of 20 or less.

4. The method for manufacturing a combined yarn bundle according to claim 1, wherein a roundness of a monofilament of the carbon fiber precursor yarn before contact with the first roller is 0.9 or more.

5. A method for manufacturing a carbon fiber comprising a step of subjecting the combined yarn bundle manufactured by the method for manufacturing the combined yarn bundle according to claim 1 to oxidation treatment and carbonization treatment to obtain a carbon fiber.

* * * * *